US008621818B1

(12) United States Patent
Glenn et al.

(10) Patent No.: US 8,621,818 B1
(45) Date of Patent: Jan. 7, 2014

(54) METHOD FOR PROVIDING STANDARDIZED MODULAR BUILDING CONSTRUCTION

(75) Inventors: Steve Glenn, Santa Monica, CA (US); Erich Volkert, Los Angeles, CA (US); Amy Sims, Los Angeles, CA (US); Finn Kappe, Santa Monica, CA (US); Karen Bragg, Los Angeles, CA (US)

(73) Assignee: LivingHomes, LLC, Santa Monica, CA (US)

( * ) Notice: Subject to any disclaimer, the term of this patent is extended or adjusted under 35 U.S.C. 154(b) by 886 days.

(21) Appl. No.: 12/229,880

(22) Filed: Aug. 26, 2008
(Under 37 CFR 1.47)

(51) Int. Cl.
*E04B 1/00* (2006.01)
*E04G 21/00* (2006.01)
*E04G 23/00* (2006.01)

(52) U.S. Cl.
USPC ..... 52/745.13; 52/79.1; 52/236.3; 52/220.1; 52/309.7; 52/309.12; 52/309.16

(58) Field of Classification Search
USPC ..... 52/79.1, 79.2, 79.11, 234, 236.3, 239, 52/745.02, 745.03, 745.08, 503, 576, 414, 52/405.1, 405.3, 309.7, 220.1, 309.16, 52/745.13, 236.5, 236.6, 262, 266, 284; 165/165, 168, 170, 53, 54
See application file for complete search history.

(56) References Cited

U.S. PATENT DOCUMENTS 2,521,540 A * 9/1950 Richardson ..... 392/435
3,095,491 A * 6/1963 Deacon ..... 392/435
3,292,327 A * 12/1966 Van Der Lely ..... 52/79.13
3,694,973 A * 10/1972 Unger ..... 52/34
3,710,534 A * 1/1973 McNamara, Jr. ..... 52/745.03
3,812,637 A * 5/1974 Yang et al. ..... 52/745.03
3,901,612 A 8/1975 Canin
3,921,355 A * 11/1975 Pennecot ..... 52/262
4,073,113 A 2/1978 Oudot et al.
4,078,345 A * 3/1978 Piazzalunga ..... 52/79.13
4,301,859 A * 11/1981 Hollemann ..... 165/49
4,490,064 A 12/1984 Durcharme
4,660,349 A * 4/1987 Tricarico ..... 52/745.03
5,643,488 A * 7/1997 Lee ..... 249/34
5,737,895 A * 4/1998 Perrin ..... 52/745.1
5,809,708 A * 9/1998 Greer et al. ..... 52/220.7
5,881,519 A * 3/1999 Newkirk ..... 52/274
5,913,777 A * 6/1999 Gerber ..... 52/35
5,987,827 A * 11/1999 Lord ..... 52/274
6,131,365 A * 10/2000 Crockett ..... 52/794.1
6,272,810 B1 * 8/2001 Ingram et al. ..... 52/742.14
6,393,774 B1 * 5/2002 Fisher ..... 52/79.1
6,481,177 B1 11/2002 Wood (Continued)

OTHER PUBLICATIONS

Kieran, Stephen. Timberlake, James. "Loblolly House—Elements of a New Architecture." 2008, Princeton Architectural Press.

(Continued)

*Primary Examiner* — Chi Q Nguyen
(74) *Attorney, Agent, or Firm* — Smyrski Law Group, A P.C.

(57) ABSTRACT

A method for providing standardized modular elements usable to construct a building. The method includes defining a set of allowable functional building block configurations divided into assembly levels, defining allowable configurations and allowable interactions for each allowable functional building block configuration usable in a building configuration. The method also includes producing standardized modular elements based on the allowable configurations and allowable interactions for a desired building configuration. Fabricated standardized modular components are provided (produced, assembled, or fabricated) at an off-site location and employed in a building at an on-site location.

13 Claims, 9 Drawing Sheets

(56) References Cited

U.S. PATENT DOCUMENTS

| | | | | |
|---|---|---|---|---|
| 6,578,330 | B1 * | 6/2003 | Bergman | 52/234 |
| 6,698,147 | B2 * | 3/2004 | Bergman | 52/234 |
| 6,826,879 | B1 * | 12/2004 | Allen et al. | 52/236.3 |
| 7,171,787 | B2 * | 2/2007 | Thomason et al. | 52/169.7 |
| 7,185,467 | B2 * | 3/2007 | Marty | 52/425 |
| 2003/0152422 | A1 | 8/2003 | Popovski | |
| 2005/0076605 | A1 | 4/2005 | Giaconi | |
| 2009/0000235 | A1 | 1/2009 | Kieran et al. | |

OTHER PUBLICATIONS

Kieran, Stephen. Timberlake, James. "Refabricating Architecture—How Manufacturing Methodologies Are Poised to Transform Building Construction." 2004, McGraw-Hill.
Proposal, "Cellophane House" (2007).
Kieran, Stephen. Timberlake, James. "Make it Right New Orleans." 2008, New Orleans.
Disclosure Statement—Kieran Timberlake.
Exh. 1—Printout of "Ronen Bekerman 3d architectural visualization blog"—http://www.ronenbekerman.com/loblolly-house-kieran-timberlake/.
Exh. 2—Figure taken from http://www.ronenbekerman.com/loblolly-house-kieran-timberlake/.
Exh. 3—Printout of "Chamdesign Blog"—http://chamdesign.tistory.com/tag/REVIT.
Exh. 4—Figure taken from http://chamdesign.tistory.com/tag/REVIT.
Exh. 5—Kieran Timberlake description of Loblolly House, Taylors Island, Maryland—http://kierantimberlake.com/featured_projects/loblolly_1.html.
Exh. 6—http://archrecord.construction.com/residential/recordhouses/2007/07loblolly.asp.
Exh. 7—Architectural Record Russell Fortmeyer Article—http://archrecord.construction.com/resources/conteduc/archives/0611edit-1.asp.
Exh. 8—http://blog.kierantimberlake.com/loblolly-house-critical-detail/.
Rexroth Bosh Group, Drive & Control Profile—"Architect has Aluminum Frame of Mind when Building Houses," 2006.
Printout of "Cellophane House" http://kierantimberlake.com/pl_sustainability/cellophane_house_1.html#.
Disclosure Statement—Rexroth Bosch Group Catalog.
Exh. A—Rexroth Bosch Group "Aluminum Structural Framing System," v6.1, (Dec. 2009), Introduction and Pictorial Table of Contents.
Exh. B—"Updates and Corrections" to Catalog v4.0 of the Rexroth Bosch Group "Aluminum Structural Framing System" (Jun. 2005).

* cited by examiner

METHOD FOR PROVIDING STANDARDIZED MODULAR BUILDING CONSTRUCTION

BACKGROUND OF THE INVENTION

1. Field of the Invention

The present invention relates generally to the field of building construction, and more specifically to providing standardized modular building construction components to realize a superstructure.

2. Description of the Related Art

Today's on-site building construction techniques typically require various suppliers and contractors to provide the necessary elements, such as raw materials, in combination with the labor necessary to complete each step in the process for producing a building, such as a single family home. Many people and building materials are required to be at the site at the appropriate time.

On-site construction may in some instances suffer schedule delays and budget overages resulting from unforeseen site conditions, such as inclement weather or permit delays, changing site conditions, subcontractor unavailability, and lack of readily available raw materials. Project managers responsible for constructing buildings within budget and on-schedule must coordinate numerous process steps and building materials that are challenging to schedule and in some instances wholly unpredictable. The process of on-site building construction is often described as "controlled chaos."

Currently, some on-site builders employ prefabricated construction techniques in erecting portions of the building, or the entire structure. Present pre-fabrication techniques can in some instances ease the need for availability of certain building materials and the labor associated with traditional non-prefabricated construction techniques. "Prefabrication" or "systems built housing" construction techniques typically involve one of four major market segments: manufactured, modular (which can be divided into custom and semi-custom), panelized, and pre-cut or kit homes. Each involves pre-formed materials, and all but manufactured homes must typically comply with local building codes.

Manufactured homes are complete dwelling units substantially or completely constructed in a factory in conformance with a national building code, an example of which is a mobile home. Modular homes are factory assembled residences built in units or sections, transported to a permanent site and erected on a foundation, and modular homes typically exclude mobile homes. Again, modular homes can be either custom or semi-custom. Custom pre-fabrication generally involves multiple modular boxes, or volumes, built to size, compliant with local codes, that define the desired final space, room, or portion thereof. Each modular box must be individually "engineered" to ensure adequate strength (e.g. shear and vertical loading), code compliance, and other structural design details. Buildings realized from custom prefabrication are therefore limited in benefits that can be offered, in some instances requiring months of additional "engineering" and code compliance verification prior to beginning of each building project. Due to the customized nature, this technique becomes problematic because it does not benefit from standardized parts. The modular "boxes" produced by today's custom methods resemble empty volumes "full of air" as the box is lacking in infrastructure, e.g. HVAC, electrical and plumbing, and exhibit low packing and shipping characteristics. Custom methods are of limited benefit due to higher costs associated with shipping "empty" modules, required individual design/engineering efforts, a lack of infrastructure, and the fact that the custom process generally provides no repeatable, reusable, or standardized components or economies of fabrication.

Semi-custom prefabrication methods typically involve a limited set of, for example, five to twenty complete individual building designs. Since the designs are known in advance, semi-custom prefabrication methods may enable configuring and building a limited set of components prior to construction. Many semi-custom designs involve choosing a pre-determined building design and constructing on-site with no modifications. In the situation where some customization is available, the resulting designs become are limited and can require re-engineering and re-approval of the initially selected building design. Semi-custom designs are further limited in that they typically require provisioning of space within multiple areas of the structure to accommodate addition of various custom features such as a tank-less in-wall water heater for a bathroom. Semi-custom designs become problematic in that the need for establishing or provisioning reserve space is inefficient and inhibits component standardization, resulting in higher overall costs.

As may be appreciated, certain advantages and disadvantages are associated with each type of housing construction technique. Certain modular systems can offer advantages over site and panelized systems in that all trades (electrical, plumbing, HVAC, etc.) can be organized in one place and can thus be readily controlled. This can minimize delays due to weather, use of tools can be leveraged, and supplies can be centralized and readily available to all trades.

Manufactured prefabrication construction of manufactured or "mobile" homes occurs in accordance with Housing and Urban Development (HUD) codes. The mobile homes produced from manufactured systems are mostly produced in a factory as a single complete structure. By HUD code, mobile homes must be transportable, with wheels attached to their foundations, and must be capable of being moved after installation. The mobile home is transported on a single vehicle or transported in a limited number of large sections and fixed at a semi-permanent location.

Manufactured systems such as these are limited, in that multi-family dwellings are not permissible according to current HUD codes. Also, due to the need to transport the dwellings on roadways, the total size of the structure is governed by inter- and intra-state vehicle codes.

Panelized prefabrication methods generally involve constructing only the building walls at a factory. The walls may be efficiently packed and shipped to the on-site construction location.

Panelized methods may afford flexible designs and allow for standardizing certain components, for example one component may be a wall with a door, where a different component may involve a window in lieu of or in combination with a door. Panelized methods become problematic because the effort to assemble the large number of panels required for realizing an entire building structure on-site remains labor intensive, including the need for internal components such as electrical, plumbing, etc. Panelized methods are typically limited to wall components and do not generally entail ceilings, floors, decks, roofs and other horizontally oriented "wall-like" components. The lack of horizontal components and the inability to define spaces for inclusion of desired features can result in increases in on-site assembly efforts, increasing costs and delaying schedule.

Off-site construction of repeatable standardized building modules in a controlled environment as part of a complete building system may eliminate many of the budget and schedule challenges associated with site-based construction.

It would therefore be beneficial to provide for standardized modular building construction that combines aspects and processes for pre-defined modules with infrastructure functional elements in an arrangement affording mobile delivery.

SUMMARY OF THE INVENTION

According to one aspect of the present design, there is provided a method for providing standardized modular elements usable to construct a building. The method comprises defining a set of allowable functional building block configurations, wherein the set of allowable functional building block configurations is divided into assembly levels, defining allowable configurations and allowable interactions for each allowable functional building block configuration usable in a building configuration, and producing standardized modular elements based on the allowable configurations and allowable interactions for a desired building configuration. Fabricated standardized modular components are provided at an off-site location and employed in a building at an on-site location.

According to another aspect of the present design, there is provided a method for constructing a building. The method comprises establishing a set of predetermined standardized modular components for building a structure, the set of standardized modular components conforming to fabrication and assembly rules for individual standardized modular components. The set of standard modular components are constructable to accommodate predetermined infrastructure functional elements therein. The method further comprises providing the set of predetermined standardized modular components from the establishing to an individual contemplating building a desired structure, thereby enabling the individual to select from among individual standardized modular components to construct the desired structure.

These and other advantages of the present invention will become apparent to those skilled in the art from the following detailed description of the invention and the accompanying drawings.

BRIEF DESCRIPTION OF THE DRAWINGS

For a more complete understanding of the present disclosure, reference is now made to the following figures, wherein like reference numbers refer to similar items throughout the figures.

Figure 1A:
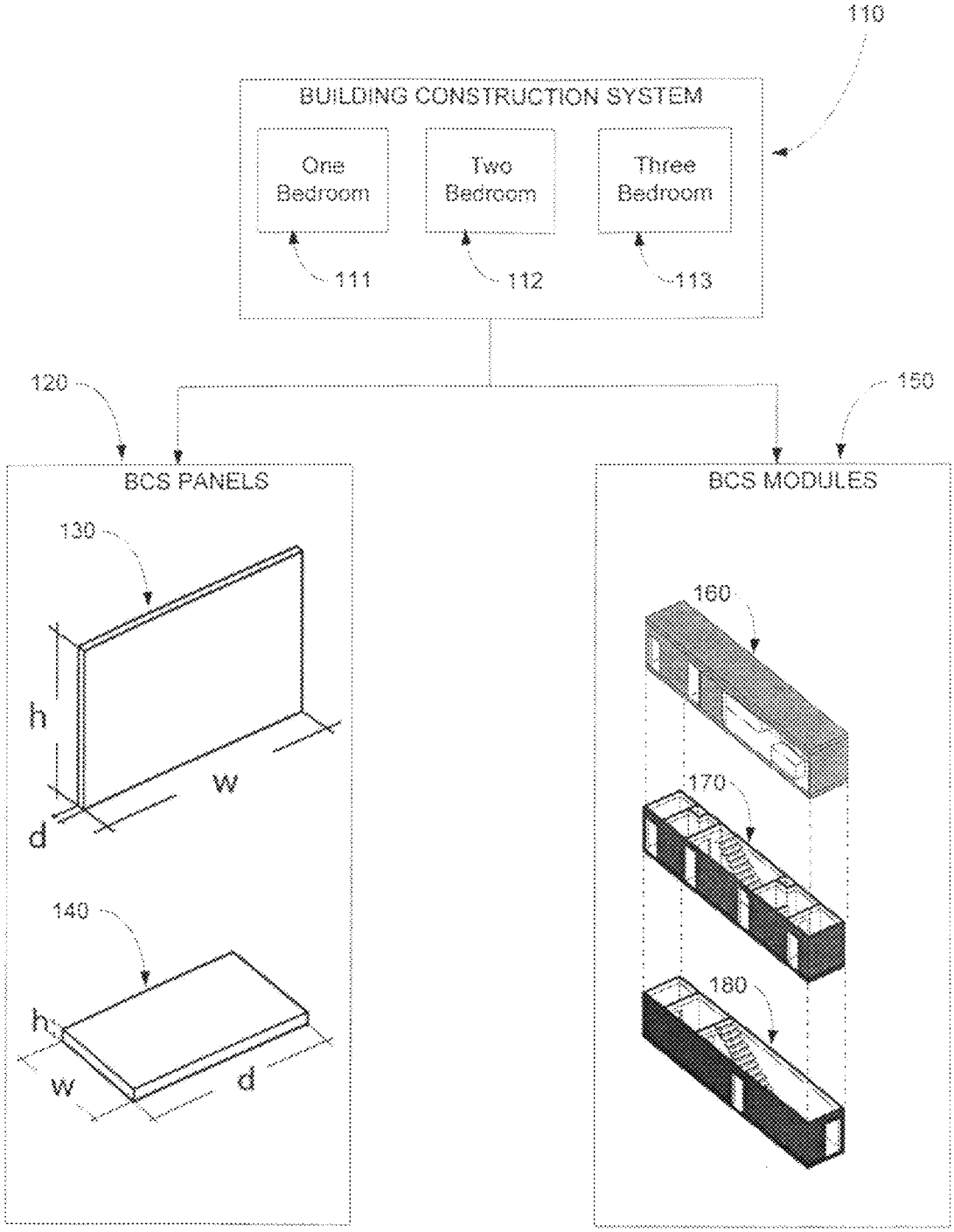
FIG. 1A diagrammatically illustrates a hybrid building construction system with modules and panels for use in accordance with one embodiment of the present design.

The exemplification set out herein illustrates particular embodiments, and such exemplification is not intended to be construed as limiting in any manner.

DETAILED DESCRIPTION OF THE INVENTION

The following description and the drawings illustrate specific embodiments sufficiently to enable those skilled in the art to practice the system and method described. Other embodiments may incorporate structural, logical, process and other changes. Examples merely typify possible variations. Individual components and functions are generally optional unless explicitly required, and the sequence of operations may vary. Portions and features of some embodiments may be included in or substituted for those of others.

In general, the present design includes a system and method for off-site creation and prefabrication of standard components that integrate beneficial aspects of mobile construction with panelized and modular building system techniques to form a hybrid building construction system and methodology. The present building construction system may configure, fabricate, and integrate components off-site that would typically be assembled and/or constructed on-site. The present building components may include but are not limited to modules and panels and the methodology may include configuring and assembling standardized building components to provide generally reusable designs and a repeatable and relatively predictable construction process.

The present design establishes structures in a way to insure that all parts of the home that require the greatest skilled labor—baths, kitchens, utility cores—are isolated into the modules, thus leveraging what modules do best. The present design employs panels to define spaces between the modules, and thus in the present design each system is leveraged to do what the system can do best.

Another aspect of the present design is the integration of infrastructure (plumbing, electrical, ducting, etc.) into individual panels, where that infrastructure had previously been integrated on site.

Note that as used herein, the terms "modules" "components" and "elements" are generally employed to mean modules are the largest building related unit, and modules include certain components formed of elements. Building system panel components may include but are not limited to walls, floors, roofs, and decks. Building system module components may configure predefined functional building blocks to form upper, lower, and mid-level positioned modules. Functional building blocks may include but are not limited to stairs, kitchens, built-in such as a home theater wall unit or other fixture, master baths, baths, and studios arranging a kitchen and bath combination. The present design building system may configure each standard component, such as modules and panels, suitable for mobile transport to the building lot or site for assembly.

The standard components of the present design may enable installation and integration of various infrastructure functional elements including but not limited to plumbing and electrical, HVAC ducting, structural framing, interior finish, exterior cladding, special purpose materials, such as thermal or sound insulating, structural, etc., and non-structural cavity furring. Space or provisions may be made for these infrastructure functional elements such that they are available when the components leave the factory and are received at the job site. The infrastructure functional elements are configured for efficient on-site assembly, such as insertion of electrical or plumbing components in a multi floor building configuration, such as for example where a kitchen sink plumbing requires a horizontal stack pipe vented out the roof.

The present design may pre-configure the a plumbing infrastructure functional element within a standard wall component, where provision for the anticipated plumbing components are sufficient to maintain panel-to-panel or panel-to-module vertical alignment between components when mated or joined on-site, with space for infrastructure including but not limited to plumbing, electrical, insulation, HVAC, and so forth. Aligning infrastructure functional elements in this way can reduce the on-site assembly time required for joining and configuring horizontally arranged components, such as (with the kitchen sink example) by pre-positioning a stack pipe at an identical location within the lower floor and associated upper floor component.

The present design may involve pre-installation preparation of portions of predefined or standardized modules where each module is configured to include all equipment integrated into a fully finished, ready-for-use, room arranged to fulfill specialized functions, such as a kitchen or bath. The present design may combine standard modules (kitchen, bath, bedroom, etc.) with standard panels that enable connection of the standard modules by providing predetermined modules with specific known pre-assembled panels at the construction site in accordance with approved architectural/engineering plans to realize a completed building. Standard modules are typically used for areas that require a high degree of coordination between trades, for example kitchens, baths, stairs, together with utility cores offered within or with the standard modules, such as HVAC, plumbing, and electric power feed with circuit breaker box.

Standard panels may be assembled or fabricated with infrastructure elements or integrated services (electrical outlet boxes, insulation, HVAC ducts, etc.) or without. Panels containing few or no integrated services, together with panels that include infrastructure functional elements for providing services, may be arranged together as desired to connect modules together. Different such panels may be employed to define remaining spaces required that are not satisfied by the use of modules (hallways, staircase landings, etc.)

The present design enables the architect, engineer, builder, or owner to increase or decrease the overall size of the final building superstructure as desired by changing (increasing or decreasing) the number of modules or panels, the size of modules or panels size, and the layout or contents of connected panels to alter dimensions of the buildings defined spaces.

The present design permits pre-installation fabrication of building modules and panels that integrate functional elements that typically would be fabricated and constructed on-site. Moving the complex construction activities associated with producing kitchens, baths, and other spaces requiring diverse highly skilled professionals from the construction site to a factory location can result in an overall reduction in total costs, expended time, construction waste, and complexities associated therewith to construct buildings of various types, styles, and sizes as compared with current traditional site-based production methods. Further, such a methodology provides the ability to change the building design, modules, and desired infrastructure within certain boundaries, without the need for re-engineering or obtaining further permits, thus providing advantages over previous pre-fabrication designs. Moving infrastructure functional element assembly from the construction site to a factory location may further contribute to cost and complexity reductions.

FIGS. 1-4 disclose embodiments of the building construction system, including representative standardized modules and panels. As may be appreciated, different modules, panels, components, and elements from those shown in FIGS. 1-4 may be employed as desired while still within the scope of the present invention. FIGS. 5-8 disclose two representative production and assembly methodologies for the present design, i.e. the building construction system process, for activities performed at the factory (off-site) and in the field (on-site).

While the term "factory" is employed herein, it is to be understood that the modules, panels, and components disclosed herein may be produced or assembled at various locations, including but not limited to a production facility particularly suited solely to preparation of the designs and pieces disclosed herein. The term "factory" as used herein indicates any off-building site location where parts or pieces are collected or assembled before processed (finished or near-finished) parts are provided to a building site, and may include one or more locations or production facilities, a site specifically suited to producing such modules, panels, or components, or a facility or facilities that perform other functions.

FIG. 1A diagrammatically illustrates a building construction system 110 involving modules 150 and panels 120 for use in accordance with one embodiment of the present design. FIG. 1A illustrates modules and panels forming a set of standard components for the hybrid building construction system 110 configured for use in fabricating an entire superstructure within a factory. The present design's building construction system 110 may be configured for prefabricating standard components to form a complete superstructure including requisite infrastructure functional elements and arranged for final for on-site assembly. Beginning at the top of the drawing, building construction system 110 is shown to form a one bedroom 111, two-bedroom 112, or three bedroom 113 home, including the various applicable modules, such as kitchen, bathrooms, bedrooms, stairways, etc. Building construction system 110 in the desired configuration may comprise a combination of standard panels 120 and standard modules 150 forming the desired home or building.

The designer may lay out the structure, such as two bedroom home 112, using known or generally available modules or panels. In certain instances, some panels or modules may not conform to the desires of the owner, who may want a larger kitchen at the expense of a dining area. In such cases, if the modules can be fabricated off site by changing known modules, this can be done; otherwise, the desired module or panel may be partially or completely fabricated on site, with the remaining modules, panels, and components produced at the factory and transported to the site.

Thus although the present design contemplates construction of an exemplary single or multi-bedroom home dwelling configuration, the present design is not limited to home construction and the construction techniques disclosed herein may be used to realize any type of superstructure, such as a warehouse, office complex, or retail store, at a location remote from a factory wherein modules, panels, and components are built or assembled. Further, non standard designs may be employed, such as a single family home having multiple stories, or more than three bedrooms.

With respect to FIG. 1A, standard panels 120 may include panels oriented in either the vertical direction (panel 130) or the horizontal direction (panel 140). Modules 150 may be configured or selected to fulfill specialized functionality within the building system, again including such modules as kitchens or baths. These may be provided on different levels, such as upper level 160, mid-level 170, and lower level 180. While shown to include stairwells in FIG. 1A, building construction system modules 150 may include rooms, stairwells at different positions on different levels, or generally square modules atop smaller rectangular modules, for example. As may be appreciated, engineering considerations for the site where the building will be situated must be considered, including adequate support in lower modules for modules on upper floors, local codes, and so forth. However, assuming local codes are generally known, numerous components may be fabricated and modules contemplated and provided to the site in a manner that requires no further on site engineering for issues such as structural support, etc.

Figure 1B:
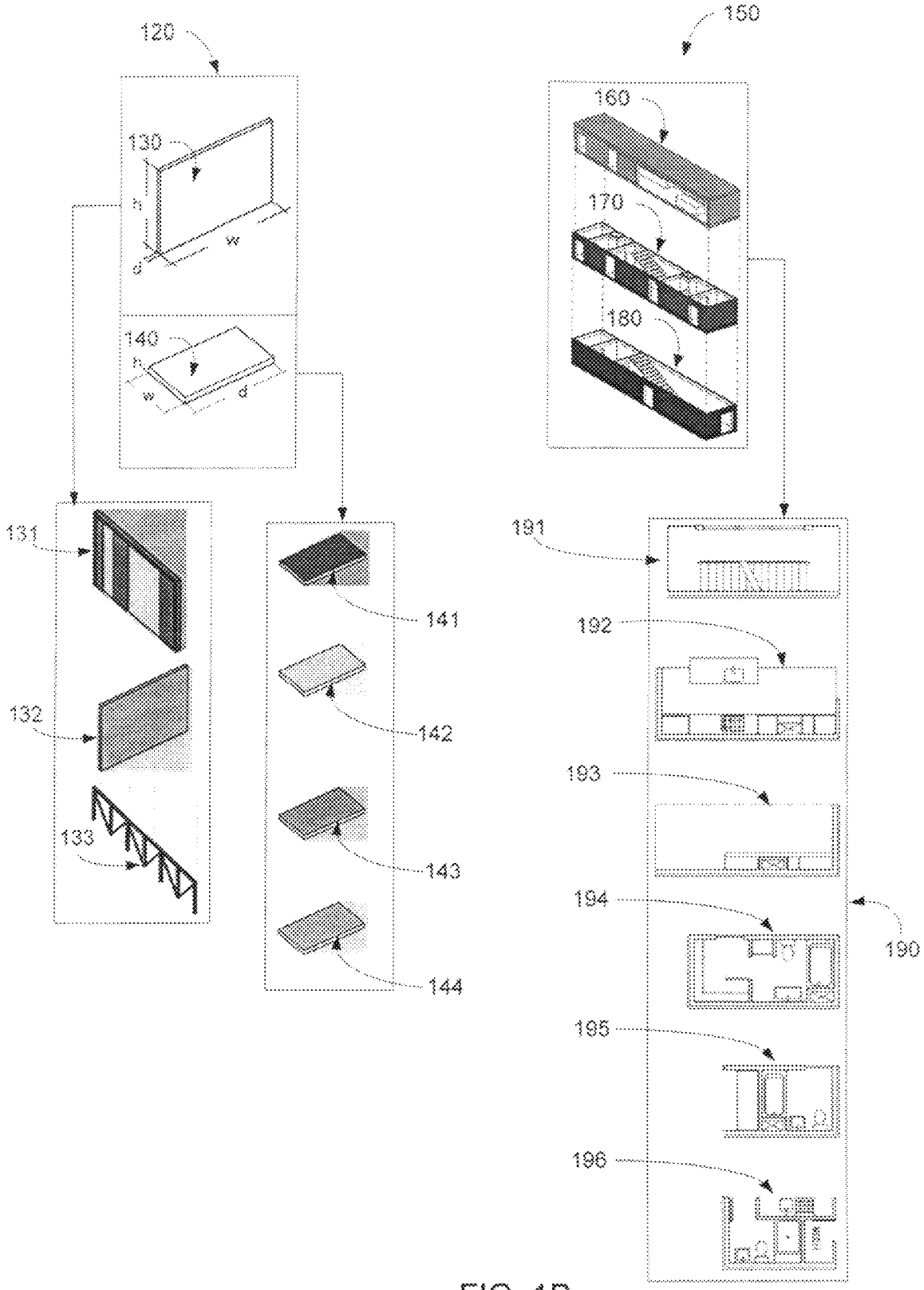
FIG. 1B diagrammatically illustrates modules and panels as standard repeatable components for use in accordance with one embodiment of the present design.

FIG. 1B diagrammatically illustrates standard modules 150 and standard panels 120 as repeatable components for use in accordance with one embodiment of the present design. The present design may configure vertical panels 130 to realize structural walls 131, nonstructural walls 132, and braced frames 133. Similarly, the present design may configure horizontal panels 140 to realize a roof 141, deck 142, intermediate floor 143, or a lower floor 144 as standard components.

In general, each of these panels may need to conform to certain requirements and desires. As may be appreciated from FIG. 3, structural wall 131 may take the form of a panel that is generally rectangular in shape such that it can fit with other panels as well as modules, and each panel typically includes infrastructure. With respect to conforming to certain requirements, as an example, structural wall 131 must have the ability to bear weight, while nonstructural wall 132 has no such requirement. Further, the amount of load that is to be borne by the structural wall 131 will dictate the composition of the wall. Further, different design materials may be employed as desired or appropriate—for example, a lower floor 144 in one structure where a subfloor is employed and a wood floor installed thereon may be of different construction from a lower floor where a slab is employed and slate flooring with radiant heating contemplated. Thus while generally standard panels are employed, different constructions of these standard panels may be realized.

In order to further produce standard repeatable components, the present design may involve building blocks 190 as standard components for configuring and constructing upper 160, mid 170, and lower 180 standard modules. The building blocks 190 or module types may include but are not limited to stairs 191, kitchens 192, built-ins 193 (wall units, wet bars, etc.), master bathrooms 194, bathrooms 195, or studios 196, where a studio combines a combined kitchen and bath.

By limiting designers (architects) to a relatively general set of pre-engineered standardized module and panel components, the present design may enable the production of superstructures from components that provide cost and schedule benefits.

Designers benefit from knowing the final design arrangement before initiating construction, based on the ability to pre-position multiple interconnected pre-defined modules and panels. Architects have knowledge that employing known modules, panels, and components will yield a structurally suitable building that meets local code requirements at a competitive price and schedule.

Figure 2:
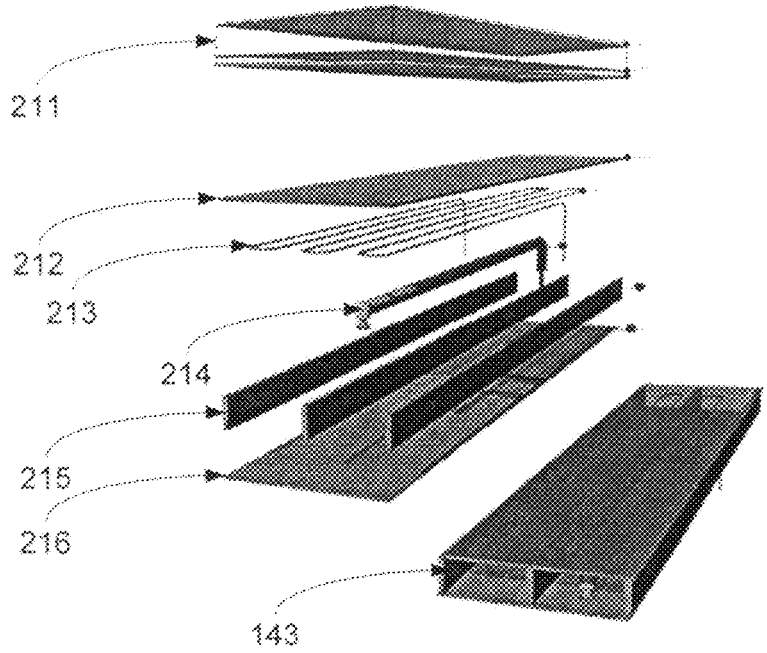
FIG. 2 illustrates an exemplary standard floor panel component for a hybrid building construction system in accordance with an aspect of the present design.

FIG. 2 illustrates one example of a horizontal panel 140 embodied as a standard component intermediate floor panel 143 for use in accordance with one embodiment of the present building construction system 110. The intermediate floor panel 143 design illustrated in FIG. 2 may integrate functional elements within the floor panel infrastructure during construction at the factory. Intermediate floor panel 143 may include but is not limited to cement board(s) 211 for thermal insulation, plywood sheathing 212 providing shear strength, radiant heat tubing 213 for heating, micro-duct air supply 214 for ventilation and air-conditioning, floor framing 215 for load bearing strength, and plywood sheathing 216 to enclose the bottom and providing a member to attach framing 215. The finished product is intermediate floor panel 143 as shown, generally ready for shipping to the building site with other panels, modules, and components.

The present design typically involves rules to govern the design and construction of each prefabricated module and/or panel. The present design's rule based system may produce an efficient, i.e. limited, set of standard repeatable panels through a process of establishing and selecting from the present design's rule set. The present design may establish rules to modify the characteristics, for example the structural material and/or dimensions, of intermediate floor panel 143 to form additional standard components such as deck 142 and roof panels 141. For example, a designer may wish to add a moisture barrier to the outside facing surface of intermediate floor panel 143 and form lower floor panel 144 component. Rules enable addition of decking material to the outside facing surface to form a standard deck panel 142, or addition of a roofing membrane applied to the outside facing surface to form a standard roof panel 141 component.

Figure 3:
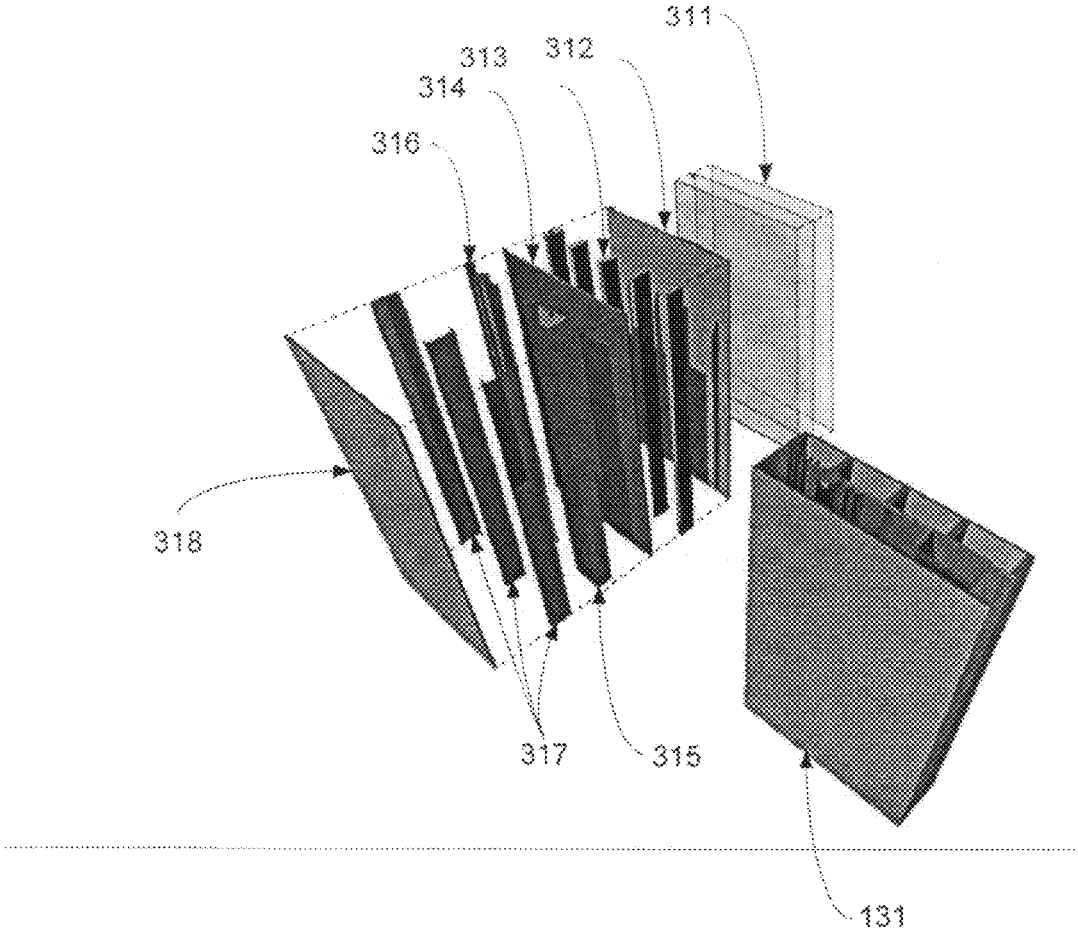
FIG. 3 illustrates an exemplary standard structural wall panel component for a hybrid building construction system in accordance with another aspect of the present design.

FIG. 3 illustrates an exemplary vertically oriented panel 130 embodied as a standard component structural wall panel 131 for use with the present hybrid building construction system 110. The structural wall panel 131 design illustrated in FIG. 3 may integrate functional elements within the panel infrastructure during construction at the factory. Structural wall panel 131 may include but is not limited to cement board(s) 311 for thermal insulation, interior finish 312 providing living space surface, structural framing 313 for load and shear strength, structural panel 314 for attaching structural framing 313, HVAC duct 315 enabling ventilation and air flow, plumbing and electrical spaces or components 316 for provisioning services, nonstructural cavity furring 317 for supporting plumbing, electrical, HVAC ducting, etc, and an exterior cladding panel 318 for protection from exposure and elements. The present design may involve a braced frame panel 133 where the construction material is steel as opposed to wood as found in similar standard components. The building construction system 110 may arrange braced frames 133 to add a standardized structural strength component for use with modules 150 and panels 120.

The present building construction system for prefabricating horizontal and vertical panels, such as is illustrated in FIG. 2 and FIG. 3, may produce standard, repeatable components in combination with assembly and production methods configured to accommodate mobile delivery of said panels. The present design may reduce costs and time to realize a superstructure at an on-site location.

The present design typically employs rules governing the design and construction of each structure and module. The present rule based system may produce an efficient, generally limited, set of standard repeatable modules arranged as design components by architects for creating unique superstructures. For example, the building construction system 110 may have a limit to the number of available module types.

Figure 4:
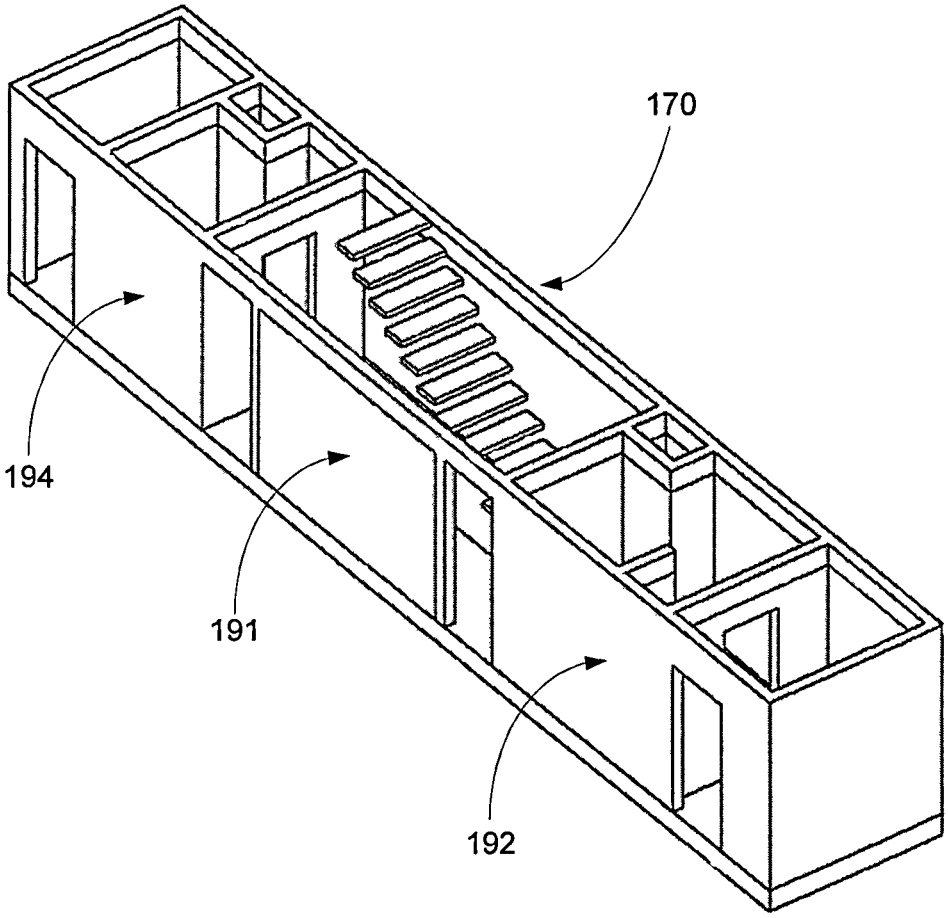
FIG. 4 illustrates an exemplary mid-level module component for a hybrid building construction system for use in accordance with an embodiment of the present design.

FIG. 4 illustrates an exemplary standard mid-level module 170 for use in the present building construction system 110. FIG. 4 illustrates a mid-level module 170 comprising three functional building blocks 190: a kitchen 192, a master bathroom 194, and a stair block 191 located in between the kitchen and bath building blocks. In one embodiment, the number of module types may be limited. For example, the present design may set the number of module types to three, such as upper, mid, and lower levels as illustrated in FIG. 4. The module types produced by hybrid building construction system 110 may also be limited, such as to use of three specific types of building blocks based on certain considerations. In this example, to form the desired module 150, the architect may configure the joining of three standard building block 190 types, or sub-modules. The building construction system 110 may establish a set of rules to indicate permissible building blocks and block locations for each standard module type, or module level. An exemplary 'rule-set' illustrating permissible building block 190 types for each module type is shown in Table 1 for one embodiment of the present design.

Table 1. Permissible Building Block Types for a Hypothetical Building Situation

TABLE 1

| | Upper | Mid | Lower |
|---|---|---|---|
| Stair | NA | X | X |
| Kitchen | X | X | X |
| Built-ins | X | X | NA |
| Master Bath | X | X | NA |
| Bathroom | X | X | NA |
| Studio | NA | NA | X |

Referring to Table 1, the exemplary rules for the upper level 160 excludes the use of stairs 191 and studios 196 from upper level module designs. The building construction system 110 design rules presented in Table 1 permit kitchens 192, built-ins 193, master bath 194, and bathroom 195 for use in designing an upper level 160.

The present design may involve establishing where individual functional building block 190 types may be located within each standard module 150. For example, in order to achieve superstructure designs that exhibit efficient airflow, the present design may indicate that for all mid-level 170 and lower level 180 modules, a block 190 type of stairs 191 must be located in the center position or slot, and a rule may indicate that no block 190 type may be located in the center position for all upper level 160 standard module designs. By selecting and affecting this requirement for the center portion, or middle slot, of each standard module 150 is always reserved for circulation. Thus architectural designs rendered using the building construction systems 110 modules 150 when produced according to the rule set described above will produce superstructures affording efficient HVAC systems.

The present design may establish a set of rules to manage the size and dimensions for modules and panels. For example, structural wall panel 131 may be configured for lengths of sixteen or twenty feet, where non-structural wall panel 132 may only be configured in twelve or fourteen foot lengths. Additional requirements may establish the modules in terms of, for example, mandating an end-to-end alignment configuration for certain modules or panels while specifically excluding side-to-side alignments.

The hybrid building construction system 110 is not limited to the examples disclosed and may involve any aspect of prefabricating and assembling standard components for use in constructing complete superstructures. The present design may involve rules for directing the number of allowable types, such as painted or stained, of interior finishes available for use in constructing modules and panels. In a similar manner, rules may be established for directing installation of a watertight membrane onto a roof panel or tile onto a floor panel. In another example, the present design may establish rules for directing door and window placement and size.

The present design's building construction system 110 for prefabricating standard horizontal and vertical panels, categorizing modules by type, and assigning permissions to each building block type indicating allowable locations within the module may produce an efficient set of standard reusable components to realize superstructure and their associated infrastructure functional elements configured for mobile delivery.

The present designs building construction system for prefabricating upper, mid, and lower level modules illustrated in FIG. 4 as standard reusable design components in combination with repeatable building construction system methods and accommodating mobile delivery of said modules may reduce costs and time to realize a superstructure at an on-site location.

In general, four phases are employed in the current design, the last phase being assembly of the structure, including interlocking pieces, providing any special or nonstandard pieces in the final structure, and performing desired tasks such as waterproofing that are not recommended or desired to be performed at the factory.

Before construction and shipping pieces to the construction site, three general phases are employed: establishing choices for designers, selecting components for the structure (design), and fabrication. The phases may take place at different times or concurrently, and it is to be understood that a single set of modules is not the only fixed design choice, but new and revised modules, panels, components and other infrastructure are being added or modified at all times. Thus while certain pieces may be being fabricated or prepared for shipping to a site, new pieces may be concurrently being created or contemplated.

Figure 5:
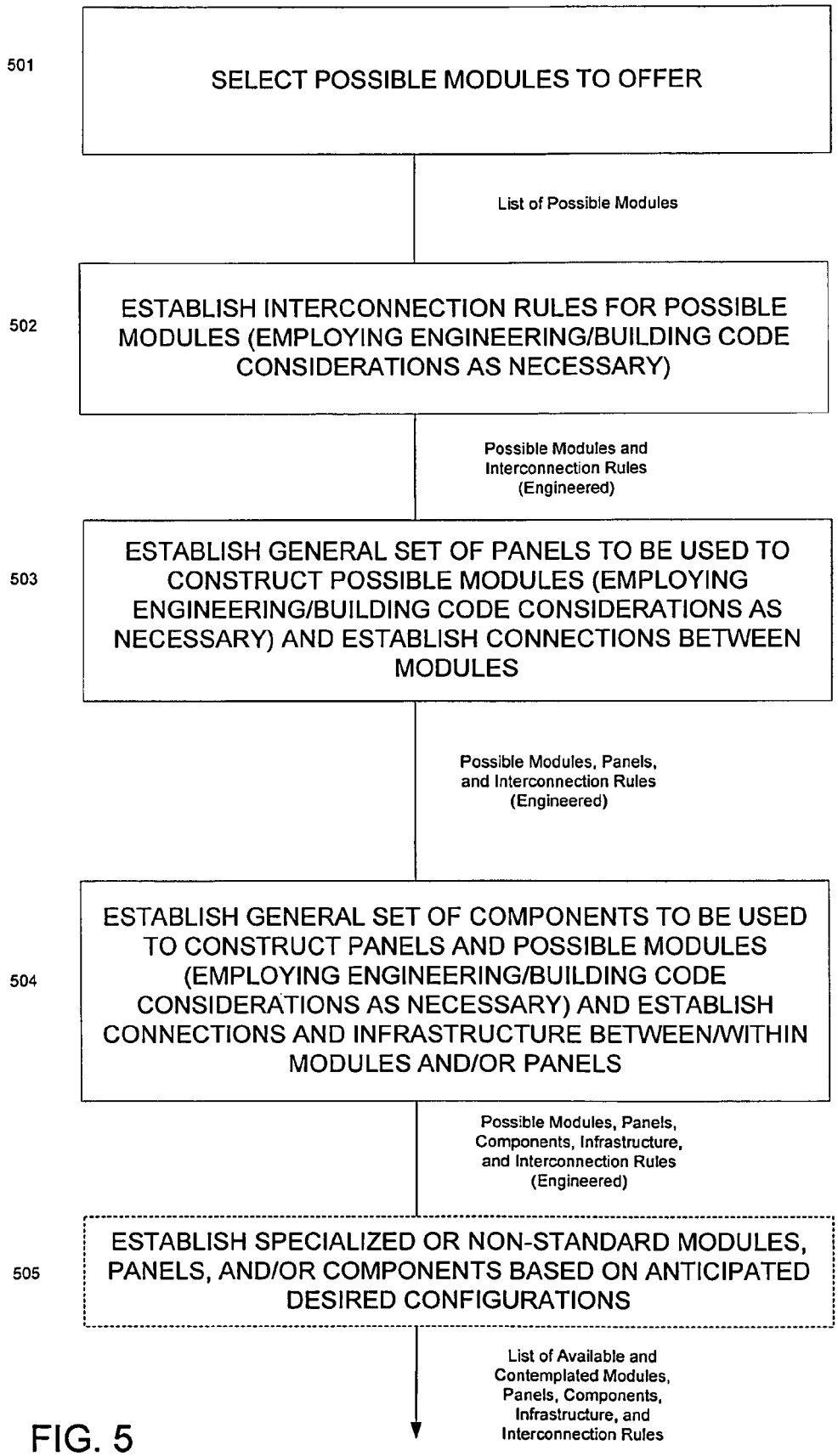
FIG. 5 is a drawing of a flowchart for establishing choices for designers and architects.
Figure 6:
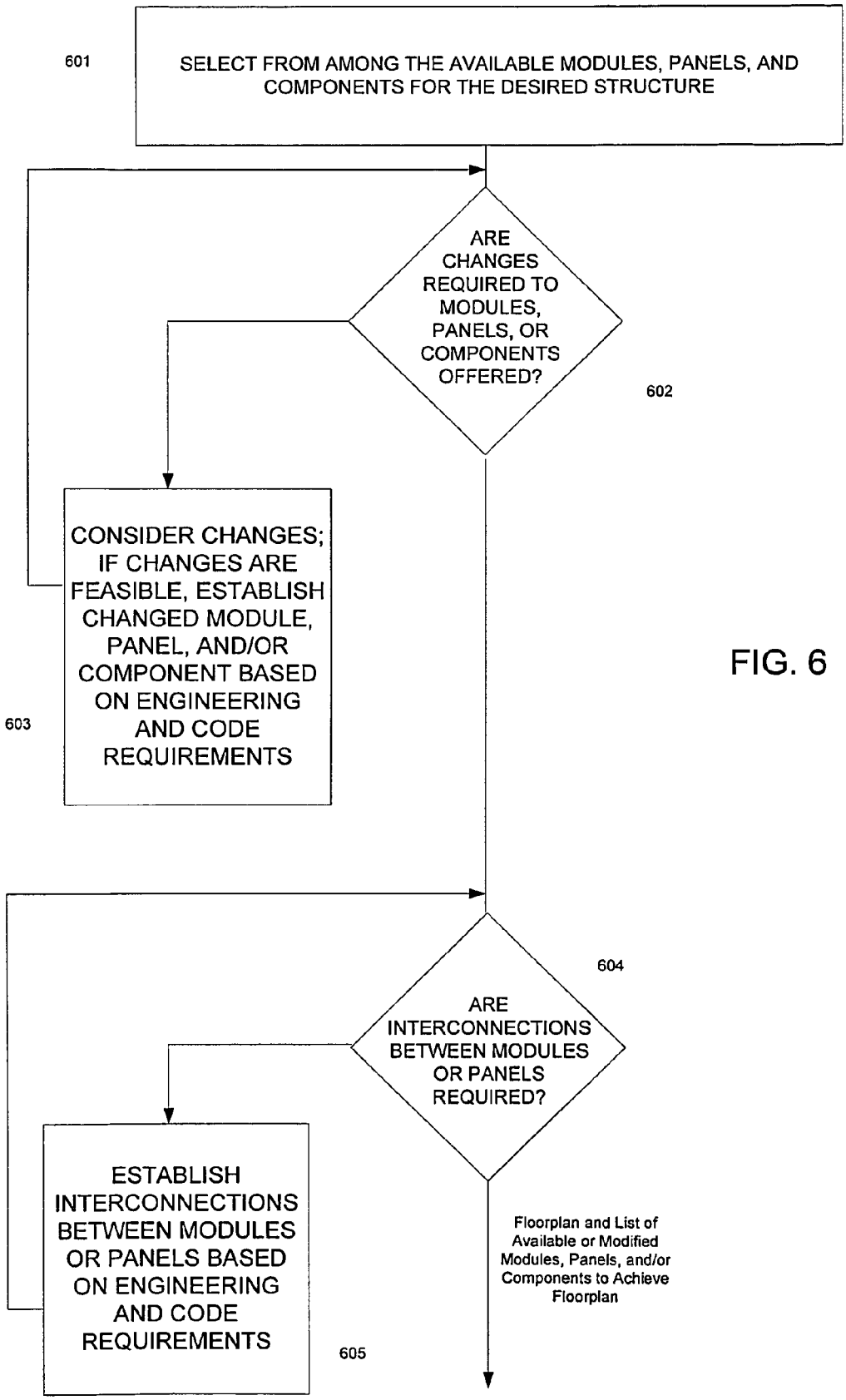
FIG. 6 shows a flowchart detailing selecting modules, panels, and components for the contemplated structure.
Figure 7:
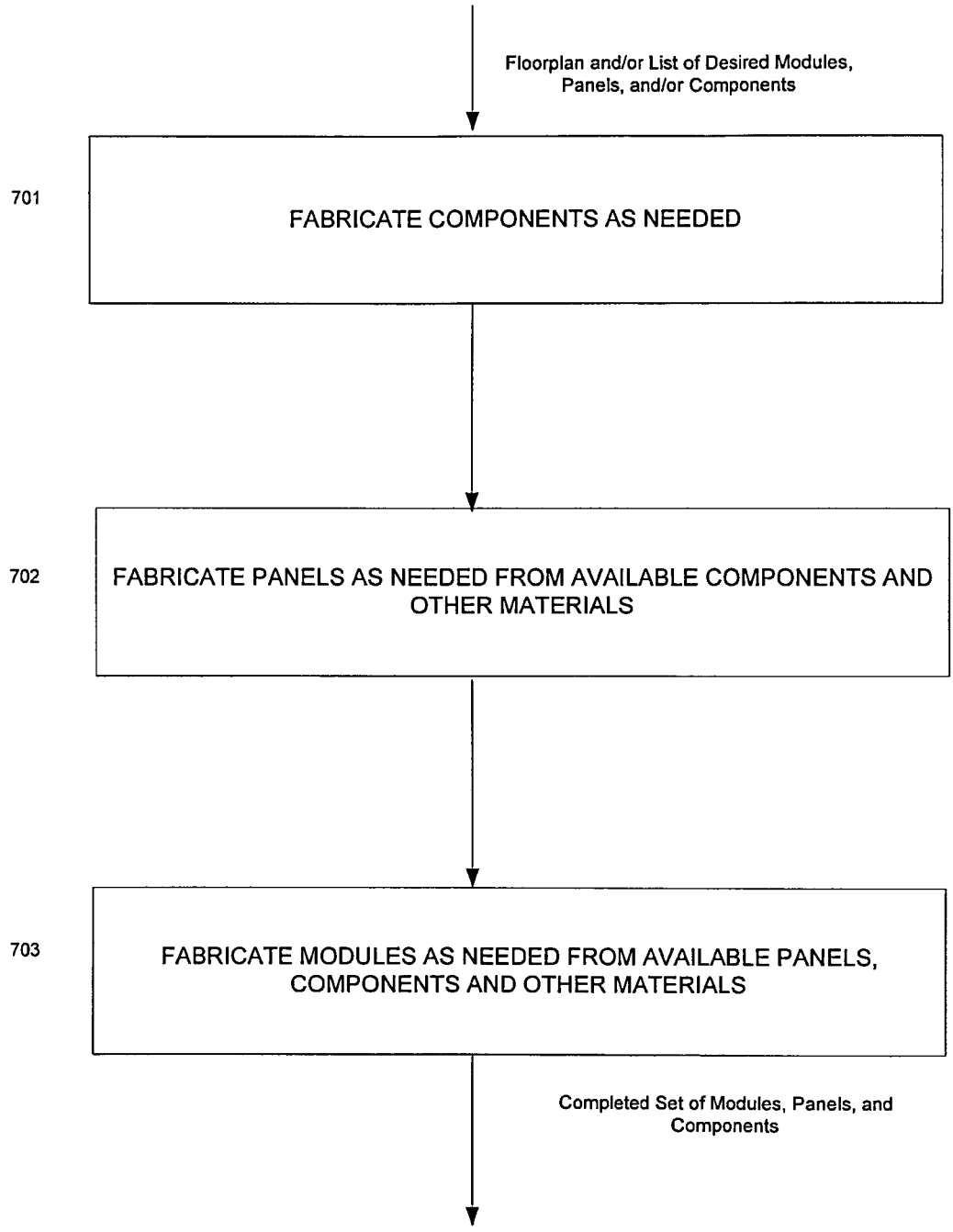
FIG. 7 is a flowchart illustrating preparation/fabrication/procurement of the modules, panels, and components needed for the structure based on the desired floorplan.

FIGS. 5 through 7 illustrate aspects of these three pre-shipping phases. From FIG. 5, point 501 establishes the possible modules that may be offered, such as a kitchen, bath, bedroom, dining area, and so forth. Within these, multiple modules may be provided, such as kitchen modules 1 through 6. The result is a list of possible modules that may be employed. Point 502 establishes interconnection rules between modules for the list of possible modules, such as kitchen 1 can be placed on a first floor but not a second floor, if bathroom 2 is provided next to master bedroom 4, a space for a double door is available, or if bedrooms 3 and 7 are desired, a hallway must be offered between the rooms. Engineering considerations are factored in at this point and throughout the points shown in FIG. 5, and building codes are considered based on anticipated installation. The result is a listing of possible modules and interconnection rules between modules. Point 503 employs the results of points 501 and 502 and selects or considers possible panel options that may be provided. In the case of a needed hallway or alcove between areas, panels may be offered that create the hallway. Also, panels used to make the possible modules may be offered, such as kitchen 1 with hard wood flooring above a subfloor may employ panels G, K or W as flooring panels, panels P, Q, and R as wall panels, and panel B as ceiling panels. Various panels may be offered as desired or necessary to realize the possible modules and interconnections therebetween, again with engineering and building codes considered. The result of point 503 is a set of possible modules, panels, and interconnection rules that may be offered to a designer.

Point 504 proceeds with establishing components, which may be used in the panels and modules, again considering engineering and building code requirements. The point of considering engineering and building code considerations along the way is so that a designer will not pick a module, panel, or component or complete design that is not engineered properly nor built to code. At this point, connections between panels, modules, and even components may be established, and infrastructure may be considered. For example, if the structure is to be located in a cold climate, the necessary insulation spacing should be provided for at this point. Other infrastructure, such as structural, plumbing, electrical, and so forth is considered at this point and again available to the designer. Point 505 is an optional function wherein additional specialized components may be considered. For example, if a six car garage is desired, provisions and/or modules may be provided. If a module is to bear a significant load, such as an extensive water load on the floor for an extremely large fish tank, or a large waterbed, such a module may be considered and offered. Other specialized modules, panels, and components may be offered as desired.

The result of point 504 or 505 is a list of available possible modules, panels, components, infrastructure, and interconnection rules, engineered and having building code considerations integrated. The complete listing can be offered to designers as a catalog or simply a listing of what may be commissioned and built before construction or assembly begins.

FIG. 6 illustrates the functions performed once the catalog or list of available or possible modules, panels, components, infrastructure, and interconnection rules are established. From FIG. 6, the designer/architect may sit down with the owners or another party and decide on the general layout or desired floorplan of the structure. The architect or designer may then select from among the available modules, panels, and components for the desired structure at point 601. Point 602 represents the question of whether changes are required, wherein changes may be to standardized possible modules, panels, or components, or nonstandard uncontemplated modules, panels, or components, such as increasing ceiling height, for example. Point 603 indicates changes are considered, either by the architect, owner, or by the party responsible for offering the module, panel or component. If changes are available, considering engineering and building code factors as well as fabrication concerns, the specialized module, panel, or component may be offered. If unavailable, the designer or architect may need to consider another design. If changes are not required, i.e. if the structure can be fabricated from available modules, panels, or components or permissively altered pieces, interconnections may be considered and established to the extent this has not already been done. Such issues regarding interconnections are considered at point 604, and these interconnections may be as large as areas between modules, such as between a kitchen and a living area spaced 10 feet away, to simple interconnections between panels, such as between a ceiling panel and an adjacent ceiling panel in a different area.

The goal at this point is to lay out or establish as much of the complete structure as possible using standardized, modified, or approved modules, panels, and/or components. If interconnections between modules or interconnections between panels are required that are nonstandard or uncontemplated, as evaluated at point 604, then at point 605 the interconnections are considered, again by either the responsible party commissioning the structure, the architect, designer, or the party offering the modules, panels, or components. If specialized pieces or changes to existing modules, panels, or components are achievable to provide interconnections between modules and/or panels, then such interconnections can be offered or established at point 605, again having considered engineering and building code issues. If such interconnections are not possible, such as they would violate local building codes, other options would need to be considered. The end result of FIG. 6 is a floorplan, and a listing of modules, panels, and components that will be required to construct a structure conforming to the floorplan. Certain specialized items may be necessary, but the listing of modules, panels, and components would include those items that can be fabricated ahead of construction, even possibly before breaking ground at the site.

FIG. 7 represents a flowchart of occurrences subsequent to establishing a floorplan and list of modules, panels, and components and before shipping items to the site, in general the fabrication process necessary. It is to be understood that certain modules, panels, or components may exist that may be employed, but the term "fabrication" or "fabricate" in FIG. 7 contemplates providing the necessary items either by procuring or producing such items in some manner. FIG. 7 generally represents the fabrication or production/procurement process. Point 701 calls for fabricating components as needed based on the floorplan and list. Point 702 calls for fabricating panels based on the floorplan and list from components and any other necessary materials. Point 703 calls for fabricating modules based on the floorplan and list from panels, components, and any other necessary materials. The end result is a completed set of modules, panels, and components transportable to the site collectively or in partial shipments that enable personnel on site to produce the structure, save for any specialized nonstandard components and joining materials or items, or items that cannot be pre-provided, such as exterior coatings that must be provided to the entire structure.

Figure 8:
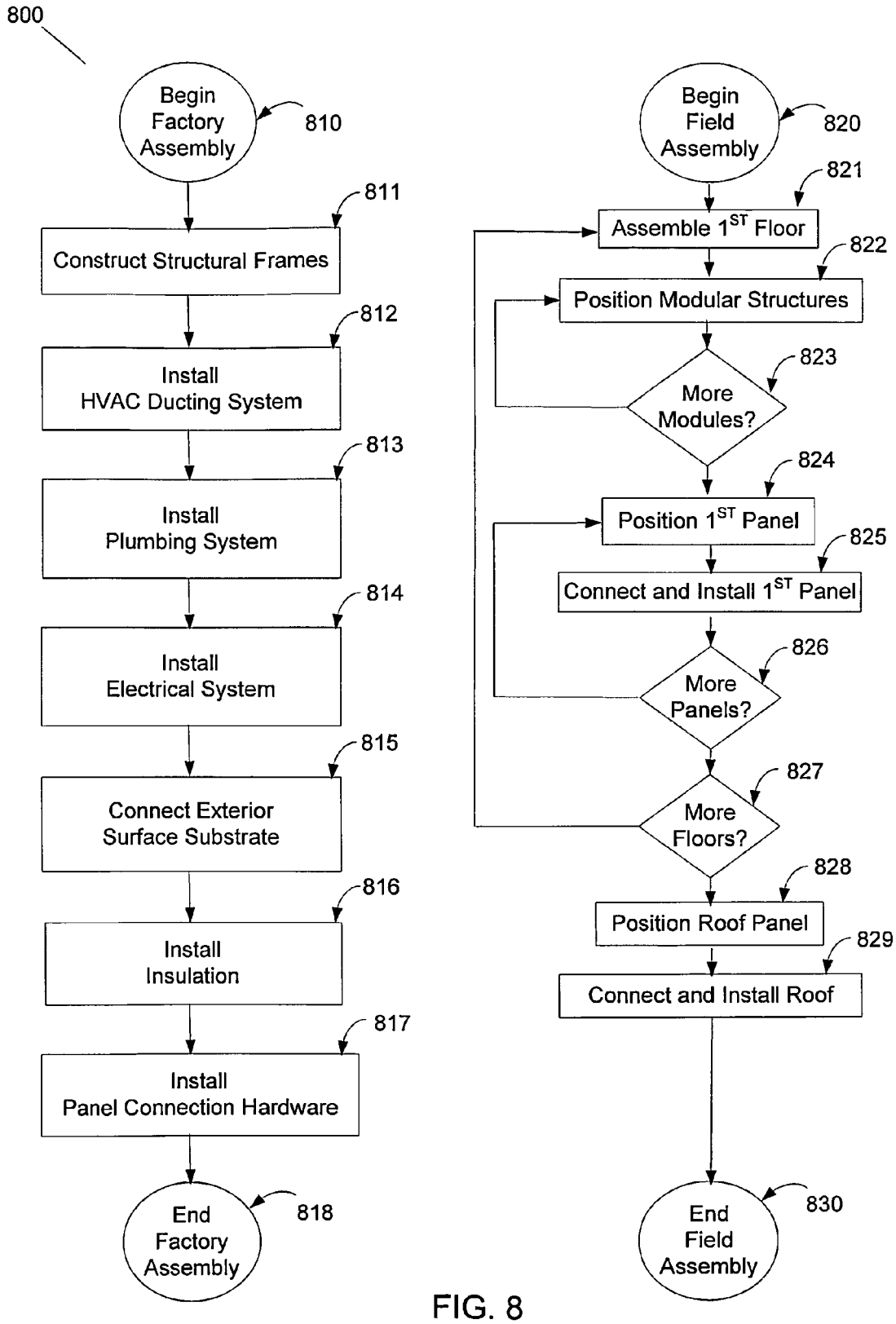
FIG. 8 is a flowchart illustrating the hybrid building construction system process flow for off-site and on-site activities.

FIG. 8 is an alternate flowchart illustrating a hybrid building construction system 800 process flow for off-site factory prefabrication and on-site field assembly activities for constructing a superstructure. The hybrid building construction system 800 may be used to produce pre-defined standardized, based on architectural plans, modules and panels in a factory configured for efficient field assembly, i.e. at the on-site location. Factory construction and assembly of prefabricated modules and panels may involve assembling of structural frames. Structural frames may involve, for example, a top plate and bottom plate with studs or joists attached within to form the initial wood framework for the present designs modules and panels.

The present design may arrange structural frames to allow mechanical, plumbing, electrical, and other infrastructure systems to connect between panel-to-panel, panel-to-module, and module-to-module. The hybrid building construction system 800 may configure the assembly for structural frames to realize standardized modules and panels. The following example describes factory assembly and production of such structural frames in accordance with an aspect of the present invention.

Factory assembly begins at point 810 and may involve the construction and assembly of structural frames at point 811. The present design may install the HVAC ducting system at point 812 within the structural frame arrangement. The plumbing system at point 813 may then be installed within the structural frame followed by the electrical system at point 814. After the infrastructure functional elements of the frame are completed, factory assembly may connect the exterior surface substrate, i.e. cladding, at point 815 to the structural frame such that a waterproofing layer may be applied or attached (not shown). Exterior panels may be positioned for fastening to one another at the building site by integrating pre-arranged lapping and waterproofing functional elements.

To complete the factory assembly process at point 819, the building construction system may involve installing insulation at point 816 and panel connection hardware at point 817. Panel connection hardware may include but is not limited to mechanical, non-permanent clips and fasteners to position and hold the interior finish panel to the structural frame. The standard panels and modules assembly required to construct a building system in accordance with the present design are completed at point 819, ending the factory assembly phase and are ready for transport to the on-site building construction location.

The present design may use the same structural frame construction technique for producing and assembling the hybrid building construction system panels and modules. The present design may realize standardized modules by arranging a plurality of structural frames configured to form each side of the module.

Field assembly may begin at point 820 with assembling the first or bottom floor level at point 821. The building construction system 800 first floor assembly may position and place modular structures at point 822 at their pre-defined location as indicated by the building architectural plans. The present design may test at point 823 to determine if additional modules remain. If additional modules require field assembly, the building construction system may return and position additional modules, looping through process steps at point 822 and 823 until all modules have been positioned. After placing the modules, the panels are ready for installation and assembly. The present design may assign an assembly order for systematically installing the panels starting with the bottom floor. The panel assembly may begin with positioning at point 824 and fastening into place to connect and install each panel at point 825 in a pre-determined order by moving around the bottom floor.

In the situation where an infrastructure functional element within one standard component must be mated, joined, or connected to another standard component, the present design may involve using the manufacturer's recommendation or in accordance with existing code requirements. For example, if the electrical system requires panel-to-panel or panel-to-module connectivity, on-site labor may involve assembling the connection using conventional means such as positioning a junction box for each spliced connection. Each wiring home run originating from intra panel and module electrical switches, outlets, and lights may terminate in a junction box as required at the factory. Similarly, all plumbing supply limes, drains, and stack pipes contained within the modules and panels may connect using convention methods, for example solder if copper pipe connections, or glue for plastic pipe connections. Other activities may involve lapping the interior walls were a vertical seam is formed between two or more joined panels, involving side-to-side and top-over-bottom lapping techniques in accordance to the interior finish manufactures directions and specifications. Exterior walls may be lapped in accordance with the exterior surface manufactures directions.

Once the bottom floor installation of modules and panels is completed, the next floor is assembled. The assembly of each subsequent floor may involve the same process of placing the modules first, followed by positioning and attaching the associated panel components of the construction system. The present design may test at point 826 to determine if additional panels remain ready for installation. If additional panels require field assembly, the building construction system may return and position additional panels, looping through process steps at points 824 through 826 until all panels have been positioned and associated infrastructure elements interconnected. The present design may test at point 827 to determine if additional levels or floors remain ready for installation. If additional levels require field assembly, the building construction system 800 may return and assemble additional levels, looping through process steps at point 821 through 827 until all floors have been assembled.

The top floor modules and panels may be configured to position a plurality of roofing panels at point 828 to the modular structure to form a watertight seal. The watertight membrane within each roof panel may be connected to each other using a gasket or pressure seal technique to waterproof the superstructure. After all the roof panels are connected and installed at point 829, the field assembly activities are complete at point 830 and the building is ready for inspection and occupancy.

By the foregoing description, an improved system and method for complete off-site prefabrication of mobile standardized building components configured for on-site assembly that minimizes on-site activities and associated effort have been described. The improved system and method may be suitable for efficient production and assembly of the various system standard components by efficiently scheduling use of skilled staff in combination with hybrid construction methods. In addition, improving the scheduling of staff may improve overall build quality by ensuring the proper skill is available when required during the off-site prefabrication process.

The foregoing description of specific embodiments reveals the general nature of the disclosure sufficiently that others can, by applying current knowledge, readily modify and/or adapt the system and method for various applications without departing from the general concept. Therefore, such adaptations and modifications are within the meaning and range of equivalents of the disclosed embodiments. The phraseology or terminology employed herein is for the purpose of description and not of limitation. Centralized production in a controlled environment can eliminate delay due to weather, allows use of jigs and certain automated tools for various tasks and trades, and reduces construction waste.

Hence the present design comprises a method for providing standardized components usable for constructing a building structure. The design comprises establishing a set of design choices for potential building structure pieces, wherein building structure pieces comprise at least one subset of the building structure, such as modules, panels, and/or components as described. The design further includes enabling a designer to select from the set of design choices, wherein the designer can establish a floorplan and a listing of desired building structure pieces based on the set of design choices and providing desired building structure pieces (modules, panels, and/or components) based on the listing of desired building structure pieces.

In other words, the present design is a method for hybrid building construction that comprises establishing a list of available standardized module and panel components, said standardized module and panel components usable to construct a building structure, establishing a listing of desired standardized module and panel components usable to construct a specific building structure design providing standardized components at an off-site location in accordance with said specific building structure design, providing the standardized components to a site for assembly, and assembling standardized components on-site in accordance with said specific building structure design.

Alternately, the present design may be considered to comprise a method for constructing building structures, comprising establishing a set of standardized modules selectable by a designer for assembly into various building structures, enabling the designer to select standardized modules from the set of standardized modules for assembly into a desired floorplan, and providing at least one standardized module selected by the designer at an off-site location for use in constructing a building structure according to the floorplan.

The present design also provides a method for providing standardized modular elements usable to construct a building. The method comprises defining a set of allowable functional building block configurations, wherein the set of allowable functional building block configurations is divided into assembly levels, defining allowable configurations and allowable interactions for each allowable functional building block configuration usable in a building configuration, and producing standardized modular elements based on the allowable configurations and allowable interactions for a desired building configuration. Fabricated standardized modular components are provided at an off-site location and employed in a building at an on-site location.

Alternately, the method for constructing a building comprises establishing a set of predetermined standardized modular components for building a structure, the set of standardized modular components conforming to fabrication and assembly rules for individual standardized modular components. The set of standard modular components are constructable to accommodate predetermined infrastructure functional elements therein. The method further comprises providing the set of predetermined standardized modular components from the establishing to an individual contemplating building a desired structure, thereby enabling the individual to select from among individual standardized modular components to construct the desired structure.

The design presented herein and the specific aspects illustrated are meant not to be limiting, but may include alternate components while still incorporating the teachings and benefits of the invention, namely a building construction system enabling off-site prefabrication of standardized modules and panels to form a complete superstructure without need for on-site centric construction efforts. While the invention has thus been described in connection with specific embodiments thereof, it will be understood that the invention is capable of further modifications. This application is intended to cover any variations, uses or adaptations of the invention following, in general, the principles of the invention, and including such departures from the present disclosure as come within known and customary practice within the art to which the invention pertains.

What is claimed is:

1. A method for providing standardized modular elements usable to construct a dwelling, comprising:

defining a set of allowable functional building block configurations, wherein the set of allowable functional building block configurations is divided into assembly levels including a low number of parts level and a high number of parts level;

defining allowable configurations and allowable interactions for each allowable functional building block configuration usable in constructing the dwelling;

selecting a plurality of standardized modular elements usable in constructing the dwelling, wherein the standardized modular elements comprise:

prefabricated modules comprising individual dwelling rooms; and a plurality of panels configured to be positioned between, fit with, and interconnect prefabricated modules and fit with the components, wherein the plurality of panels are each generally rectangular in shape and are configured to fit together and include necessary infrastructure therein, the necessary infrastructure comprising plumbing hardware, electrical hardware, HVAC ducting hardware, insulation materials, structural framing hardware, interior finish materials, and exterior cladding materials, and at least one panel comprises a floor panel configured to fit together with at least one other floor panel, said floor panel comprising a cement board and having a top plywood sheathing layer, a radiant heat tubing member, a micro air-duct supply member, a framing member, and a bottom plywood sheathing layer configured to attach to said framing member and enclose the bottom floor panel;

wherein selecting the plurality of modular elements usable in constructing the dwelling comprises:

determining distances between standardized modular elements and selecting standardized modular elements that fit together based on desired distances between standardized modular elements; and ensuring the standardized modular elements when assembled together will satisfy dwelling structural requirements;

producing produced standardized modular elements including produced panels comprising produced necessary infrastructure therein, the produced standardized modular elements corresponding to the plurality of standardized modular elements usable in constructing the dwelling;

delivering the produced standardized modular elements including the produced panels comprising the produced necessary infrastructure therein to a building site; and constructing the dwelling at the building site using the produced standardized modular elements including the produced panels comprising the produced necessary infrastructure according to one allowable functional building block configuration.

2. The method of claim 1, further comprising refining the set of allowable functional building block configurations by adding a set of new allowable functional building block configurations, such that the allowable functional building block configurations comprise a set of original allowable functional building block configurations combined with a set of new allowable functional building block configurations.

3. The method of claim 1, wherein defining allowable configurations and allowable interactions for each allowable functional building block configuration usable in constructing the dwelling comprises assessing engineering requirements and disallowing any allowable functional building block configuration failing to conform to known building codes for a plurality of potential sites.

4. The method of claim 1, wherein selected standardized modular components are fabricated in a form configured to receive acceptable installable infrastructure and comprising the plumbing hardware, electrical hardware, HVAC ducting hardware, insulation materials, structural framing hardware, interior finish materials, and exterior cladding materials.

5. The method of claim 4, wherein the acceptable installable infrastructure includes thermal or sound insulating materials and structural and non-structural cavity furring.

6. A method for constructing a dwelling from standardized modular components, comprising:

defining a plurality of allowable functional building block configurations usable in constructing dwellings, wherein the set of allowable functional building block configurations is divided into assembly levels including a low number of parts level and a high number of parts level;

defining allowable configurations and allowable interactions for each allowable functional building block configuration usable in constructing the dwelling;

establishing a set of standardized modular elements in accordance with one selected allowable functional building block configuration, the set of standardized modular elements usable for constructing the dwelling according to the one allowable functional building block configuration, wherein the set of standardized modular elements comprise:

prefabricated modules comprising individual dwelling rooms;

components comprising floors and roofs; and a plurality of panels configured to be positioned between, fit with, and interconnect prefabricated modules and fit with the components, wherein the plurality of panels are each generally rectangular in shape and are configured to fit together and include necessary infrastructure therein, the necessary infrastructure comprising plumbing hardware, electrical hardware, HVAC ducting hardware, insulation materials, structural framing hardware, interior finish materials, and exterior cladding materials, and at least one panel comprises a floor panel configured to fit together with at least one other floor panel, said floor panel comprising a cement board and having a top plywood sheathing layer, a radiant heat tubing member, a micro air-duct supply member, a framing member, and a bottom plywood sheathing layer configured to attach to said framing member and enclose the bottom floor panel;

wherein establishing the set of standardized modular elements comprises:

determining distances between prefabricated modules and selecting panels that fit together between prefabricated modules based on desired distances between prefabricated modules; and ensuring the standardized modular elements when assembled together will satisfy dwelling structural requirements;

fabricating a fabricated set of standardized modular elements including fabricated panels including fabricated necessary infrastructure therein, the fabricated set of standardized modular elements fabricated according to the one selected allowable functional building block configuration, wherein said fabricating occurs at an off-site location;

delivering the fabricated set of standardized modular elements including the fabricated panels including the fabricated necessary infrastructure therein to a building site; and constructing the dwelling at the building site using the fabricated standardized modular elements including fabricated panels including the fabricated necessary infrastructure therein according to the one selected allowable functional building block configuration.

7. The method of claim 6, further comprising adding a set of new allowable standardized modular elements, such that the allowable standardized modular elements comprise a set of original standardized modular elements combined with the set of new allowable standardized modular elements.

8. The method of claim 6, wherein selected individual standardized modular elements are fabricated in a form configured to receive acceptable installable infrastructure functional elements and comprising the plumbing hardware, electrical hardware, HVAC ducting hardware, insulation materials, structural framing hardware, interior finish materials, and exterior cladding materials.

9. The method of claim 8, wherein the acceptable installable infrastructure functional elements include thermal or sound insulating materials and structural and non-structural cavity furring.

10. A method for constructing a dwelling, comprising:

defining a plurality of allowable functional building block configurations usable in constructing dwellings, establishing a set of predetermined standardized modular elements in accordance with one allowable functional building block configuration, the set of predetermined standardized modular elements usable for constructing the dwelling according to the one allowable functional building block configuration, the set of predetermined standardized modular elements configured to accommodate predetermined infrastructure functional elements therein, wherein the predetermined standardized modular elements comprise:

prefabricated modules comprising individual dwelling rooms; and a plurality of panels configured to be positioned between, fit with, and interconnect prefabricated modules and fit with the components, wherein the plurality of panels are each generally rectangular in shape and are configured to fit together and include the predetermined infrastructure functional elements therein, the predetermined infrastructure functional elements comprising plumbing hardware, electrical hardware, HVAC ducting hardware, insulation materials, structural framing hardware, interior finish materials, and exterior cladding materials, and at least one panel comprises a floor panel configured to fit together with at least one other floor panel, said floor panel comprising a cement board and having a top plywood sheathing layer, a radiant heat tubing member, a micro air-duct supply member, a framing member, and a bottom plywood sheathing layer configured to attach to said framing member and enclose the bottom floor panel;

wherein establishing the set of predetermined standardized modular elements comprises:

determining distances between prefabricated modules and selecting panels that fit together between prefabricated modules based on desired distances between prefabricated modules; and ensuring the predetermined standardized modular elements when assembled together will satisfy dwelling structural requirements;

fabricating a fabricated set of predetermined standardized modular elements including necessary infrastructure according to the one allowable functional building block configuration, wherein said fabricating occurs at an off-site location;

delivering the fabricated set of predetermined standardized modular elements including necessary infrastructure to a building site; and constructing the dwelling at the building site using the fabricated predetermined standardized modular elements including necessary infrastructure according to the one selected allowable functional building block configuration.

11. The method of claim 10, further comprising adding a set of new allowable functional building block configurations such that the allowable functional building block configurations comprise a set of original allowable functional building block configurations combined with the set of new allowable functional building block configurations.

12. The method of claim 10, wherein selected individual standardized modular elements are fabricated in a form configured to receive acceptable installable infrastructure functional elements and comprising the plumbing hardware, electrical hardware, HVAC ducting hardware, insulation materials, structural framing hardware, interior finish materials, and exterior cladding materials.

13. The method of claim 12, wherein the acceptable installable infrastructure functional elements includes thermal or sound insulating materials and structural and non-structural cavity furring.

* * * * *